US005704691A

United States Patent [19]

Olson

[11] Patent Number: 5,704,691

[45] Date of Patent: Jan. 6, 1998

[54] PADDED CHAIR CONSTRUCTION

[75] Inventor: Ogden R. Olson, Muscatine, Iowa

[73] Assignee: Hon Industries Inc., Muscatine, Iowa

[21] Appl. No.: 655,339

[22] Filed: Jun. 6, 1996

[51] Int. Cl.[6] ..... A47C 7/18

[52] U.S. Cl. ..... 297/452.55; 297/452.59; 297/452.37; 297/452.27; 297/452.26; 297/452.15; 297/452.54; 5/655.9

[58] Field of Search ..... 297/452.12, 452.15, 297/452.26, 452.27, 452.32, 452.37, 452.54, 452.55, 452.57, 452.59, 452.31; 5/655.9, 740

[56] References Cited

U.S. PATENT DOCUMENTS

| | | | |
|---|---|---|---|
| 3,612,607 | 10/1971 | Lohr | 297/452.27 |
| 3,675,970 | 7/1972 | Bereday | 297/452.27 |
| 4,099,278 | 7/1978 | Parisi | 5/455.9 |
| 5,067,772 | 11/1991 | Koa | 297/452.55 |
| 5,370,444 | 12/1994 | Stalik | 5/655.9 |
| 5,462,339 | 10/1995 | Schmale et al. | 297/452.15 |

*Primary Examiner*—Peter M. Cuomo
*Assistant Examiner*—Anthony D. Barfield
*Attorney, Agent, or Firm*—Jones, Day, Reavis & Pogue

[57] ABSTRACT

A cushion for forming the seat or back of an upholstered chair comprises a rigid unitary body member having a central, relatively flat portion between two marginal edge portions with upstanding ridges formed along each of the two edge portions. The ridges define a central depressed portion which is capable of receiving one or more layers of foam. A foam layer covers both the central layer or layers of foam and wraps over and around the edge ridges to pad the ridges. The ridges thereby serve to reduce precompression of the central foam layer or layers after the form is finished with a covering of upholstery. A chair having cushions with enhanced softness is thereby achieved. In another aspect of the invention, a form for a chair back includes a series of vertical spaced ribs in the lumbar region of the chair back. The ribs also serve to enhance the compressibility of the foam.

3 Claims, 3 Drawing Sheets

PADDED CHAIR CONSTRUCTION

BACKGROUND OF THE INVENTION

1. Field of the Invention

The present invention relates generally to foam padded chair construction and more particularly, to a chair form which permits the seat or back to be constructed with improved comfort to the user by virtue of minimizing compression of the foam inner layer after the chair form is upholstered.

2. Description of the Prior Art

Since ancient times, chairs have been constructed using chair forms of some type covered with padding and fabric or leather upholstery to create seat and back cushions. One common type of such chair which is still in widespread use is an executive office chair. Typically, this type of chair is constructed using a relatively rigid seat pan and back form covered with one or more layers of compressible foam padding and then finished with a covering of upholstery material such as fabric or leather. The fabric or leather is attached to the seat pan or back form usually by stapling or tacking.

A generally accepted requirement of such a chair construction is that, for comfort, the foam padding material must be relatively compressible to conform to the anatomy of the user's body when seated. To this end, open cell urethane foams have been used advantageously as padding, particularly in the construction of office chairs. However, a disadvantage of standard chair construction using urethane foam is that during upholstery of a typical chair form, such as a seat pan or seat back, the upholstery attaching process precompresses the foam by reason of the tight stretching of the fabric or leather over the form. This naturally results in a chair seat or back which is relatively firm and can be uncomfortable to the user particularly over extended periods of seating.

Accordingly, it is desirable to provide a chair construction using a rigid seat pan or seat back together with foam padding and upholstery, but in which the foam is not precompressed appreciably in the upholstery attaching process and thus the chair has a softer, more comfortable feel, particularly upon initial contact by a user.

SUMMARY OF THE INVENTION

The present invention improves over the prior art by providing a chair form for forming the seat or back of an upholstered chair comprising a rigid unitary body member having a central, relatively flat portion between two marginal edge portions with upstanding ridges formed along each of the two edge portions. The ridges define a central depressed portion which is capable of receiving one or more layers of foam. A foam layer covers both the central layer or layers of foam and wraps over and around the edge ridges to pad the ridges. The ridges thereby serve to reduce precompression of the central foam layer or layers after the form is finished with a covering of upholstery. A chair having cushions with enhanced softness is thereby achieved. In another aspect of the invention, a form for a chair back includes a series of vertical spaced ribs in the lumbar region of the chair back. The ribs also serve to enhance the compressibility of the foam.

BRIEF DESCRIPTION OF THE DRAWINGS

The foregoing and other novel features and advantages of the invention will be better understood upon a reading of the following details description taken in conjunction with the accompanying drawings wherein.

DETAILED DESCRIPTION OF THE PREFERRED EMBODIMENTS

Figure 1:
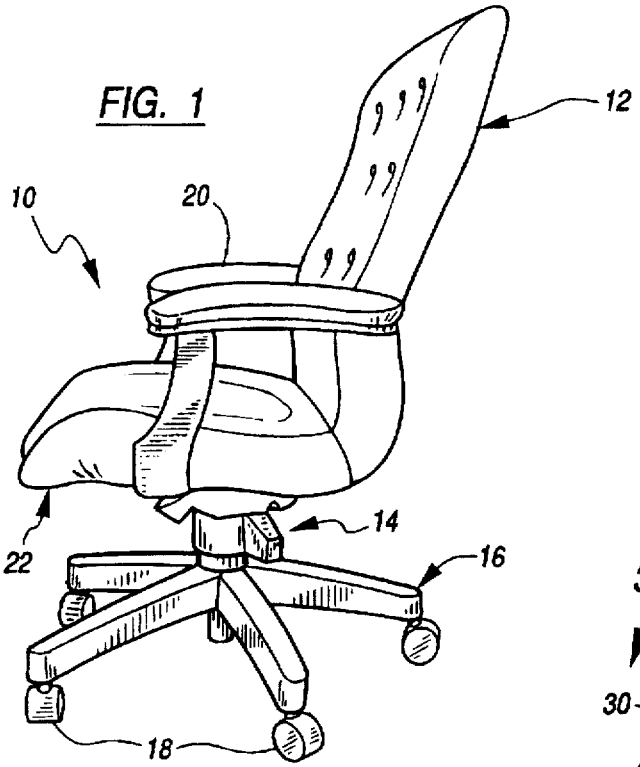
FIG. 1 is a side perspective view of an executive office chair of a type suitable to be constructed in accordance with the principles of the invention.

Referring now to the drawings, and initially to FIG. 1, a chair suitable for construction in accordance with the principles of the invention is designated generally by the reference numeral 10. The illustrated chair 10 is of a type used as an executive office chair. To this end, it has a relatively high back 12, a swivel mechanism 14 and star base 16 with casters 18. Arms 20 are disposed between the back 12 and seat 22. The swivel mechanism 14 also may, in one form, be part of a synchronous control, as well-known in the art, for permitting back tilt and seat tilt. As will be described in detail hereinafter, the back 12 and seat 22 are constructed essentially as upholstered cushions.

Figure 2:
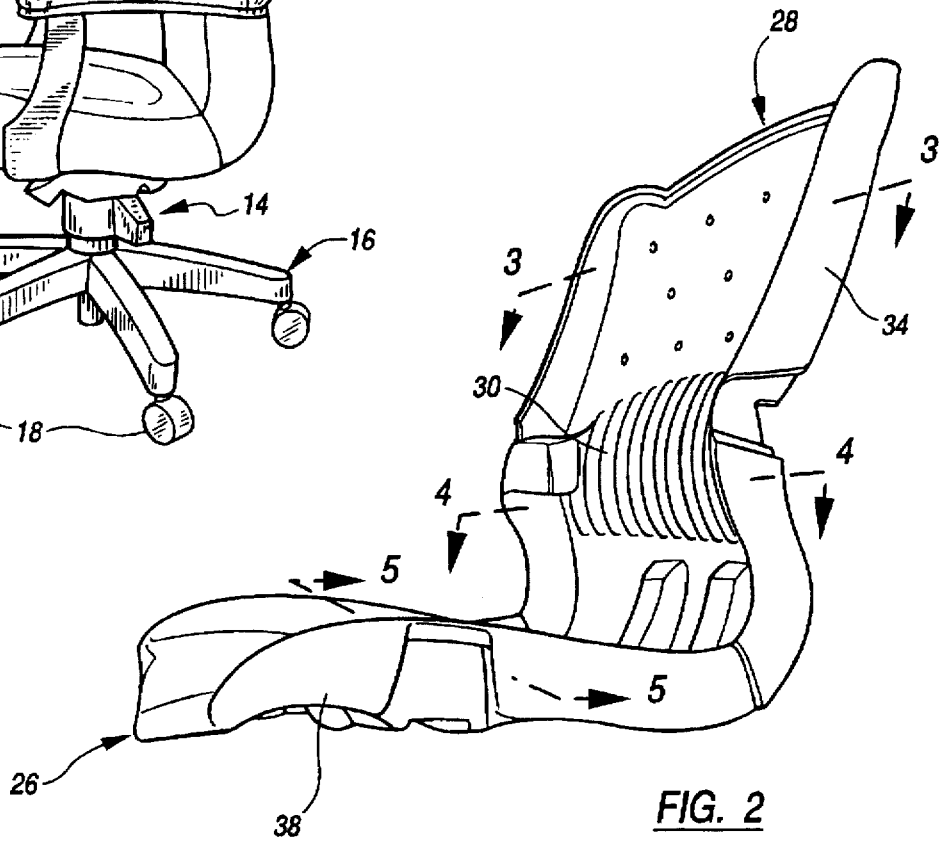
FIG. 2 is a side perspective view of an assembly of a seat pan and back form constructed in accordance with the invention.
Figure 3:
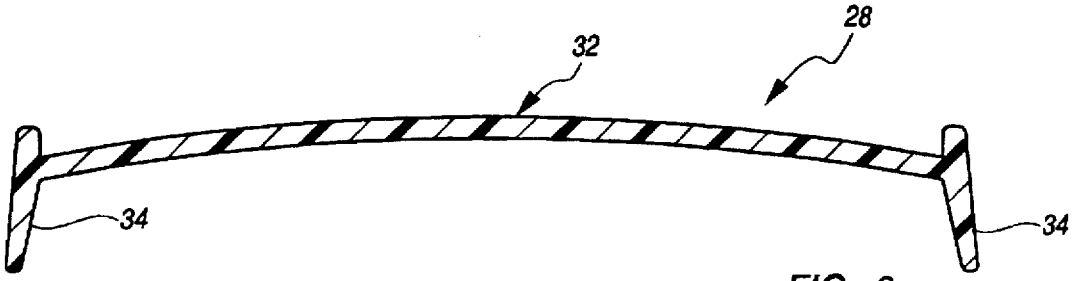
FIG. 3 is a cross-sectional view taken substantially along the line 3—3 of FIG. 2.
Figure 4:
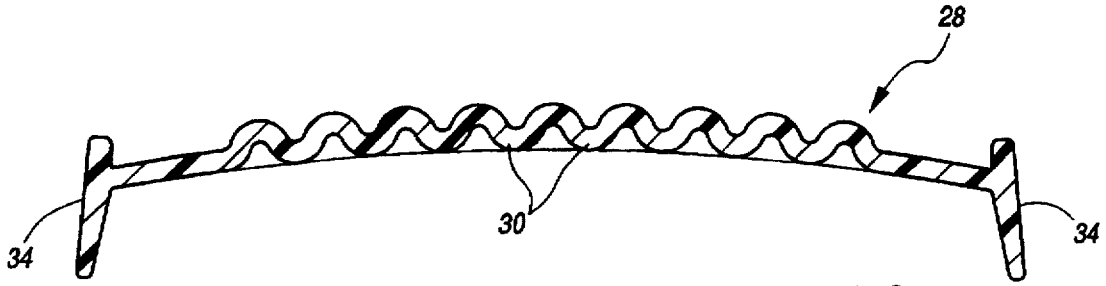
FIG. 4 is a cross-sectional view taken substantially along the line 4—4 of FIG. 2.
Figure 5:
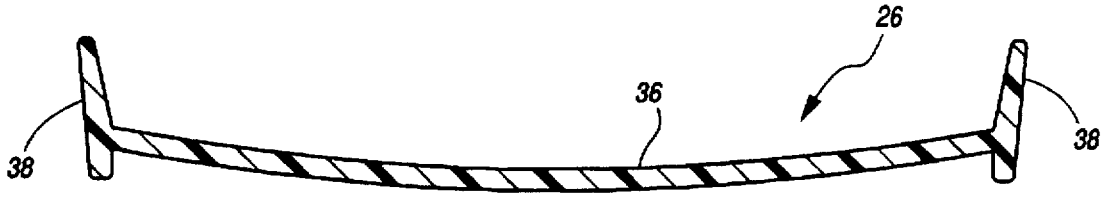
FIG. 5 is a cross-sectional view taken substantially along the line 5—5 of FIG. 2.

Turning now to FIG. 2, principal structural components of the chair 10 can be seen as comprising a seat pan 26 and a back form 28. While these members 26 and 28 may be constructed of a variety of rigid materials, such as wood, particle board or the like, preferably they are individually molded from a suitable rigid plastic material. The back form 28 may, in one aspect of the invention, include a plurality of spaced vertical ribs 30 positioned at approximately the lumbar region of the user's back for purposes which will be described in detail hereinafter. As can be seen, particularly in the cross-sectional view of FIGS. 3–5, the back form 28 has a relatively flat central portion 32 with edges formed with upstanding ridges 34. Likewise, the seat pan 26 is formed in accordance with the invention with a relatively flat central portion 36 and with edges comprising upstanding ridges 38.

Figure 6:
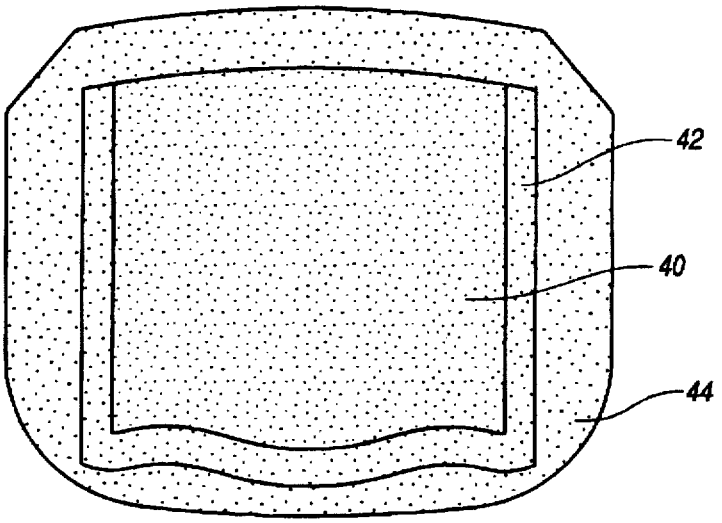
FIG. 6 is a plan view of an assembly of foam pieces used to pad the seat of the chair.
Figure 7:
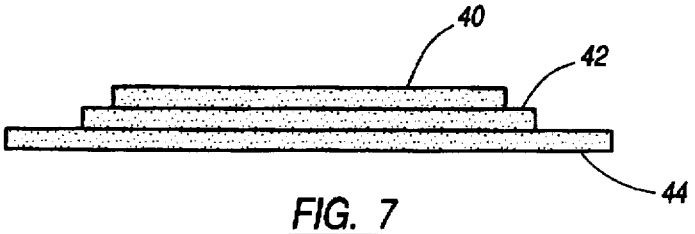
FIG. 7 is a side view of the foam assembly.

The foam padding for the seat pan 26 is illustrated in FIGS. 6 and 7 and comprises a first layer 40 of urethane foam dimensioned and configured to be placed within the ridges 38 and overlying the central portion 36 of the pan 26. Adhered to the fist layer 40 by a suitable adhesive is a second layer 42 of urethane having as slightly larger shape than the first layer 40. A final third layer 44 of foam is adhered to the second layer 42 and has a considerably larger shape in plan than the layer 42.

Figure 8:
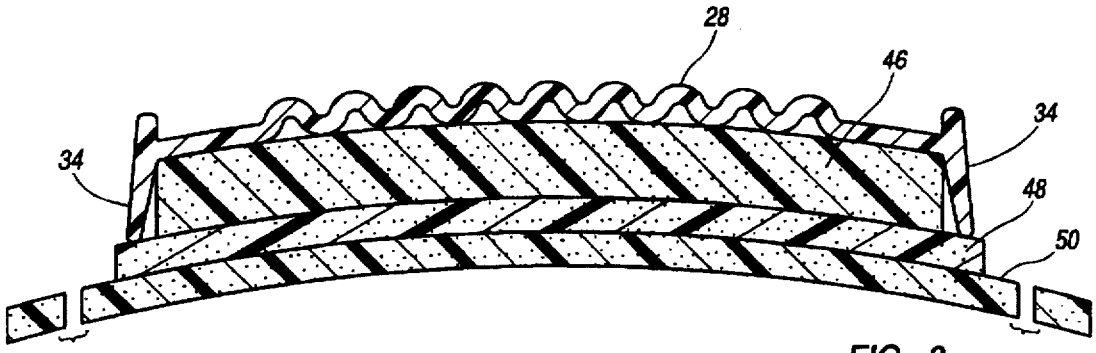
FIG. 8 is a cross-sectional view of the back of the chair with foam pieces positioned prior to upholstery installation.

FIG. 8 illustrates a similar assembly of a first layer 46, a second layer 48 and a third layer 50 of urethane foam shown positioned on the back form 28 prior to application of upholstery. As in the case of the seat pan padding construction, the first layer of foam 46 for the back form 28 fits well within the ridges 34 of the back form 28, the second layer 48 is dimensioned and configured to substantially span the ridges 34 and the third layer 50 considerably overlaps the ridges 34.

Figure 9:
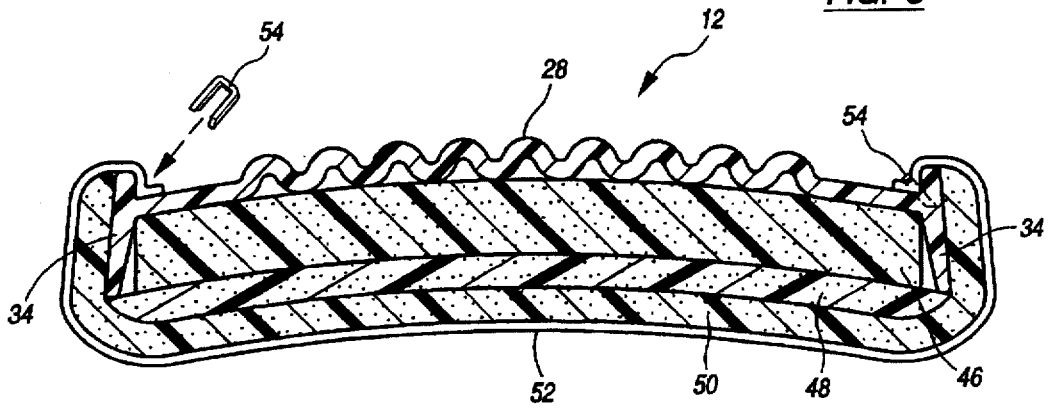
FIG. 9 is a cross-sectional view of the back of the chair after upholstery installation.

Turning now to FIG. 9, the completed padding assembly of the back form 28 can be seen. The outermost layer 50 of foam is wrapped over and around the ridges 34 and thereby pads the ridges 34. A layer of upholstery 52 covers the foam layer 50 and is wrapped completely around the side of the form 28 whereupon it is attached to the back of the form 28 by suitable staples 54.

Figure 10:
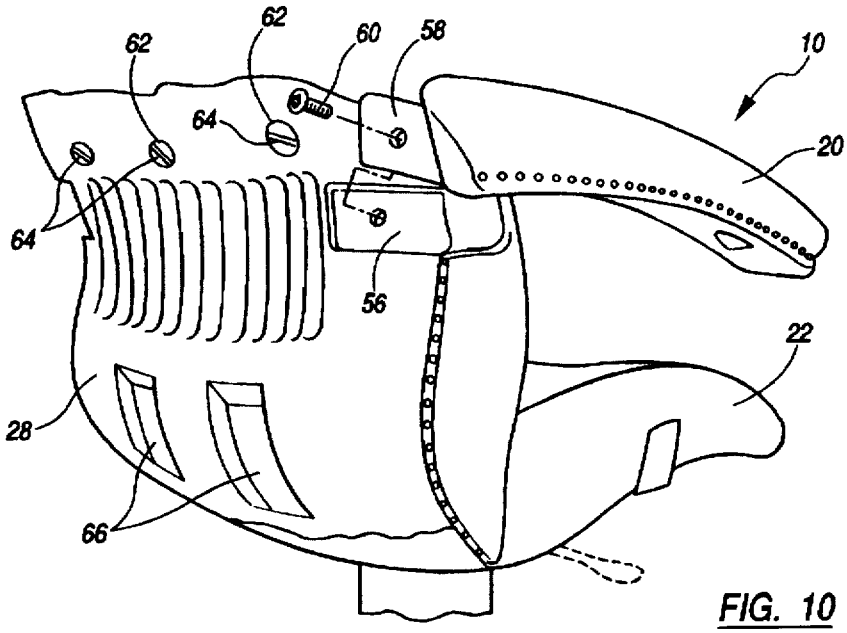
FIG. 10 is a partial rear perspective view of the chair at one stage of its construction.

A chair 10 constructed in accordance with the invention is shown, for example, in FIG. 10. The back form 28 may be provided with suitable recesses 56 for receiving brackets 58 extending from the arms 20 and secured therewithin by screws 60. Recesses 62 may also be provided for receiving barbs 64 of upholstery buttons. The back 28 may also be recessed to receive attachment brackets 66 which connect the back either to the control mechanism 14 or the seat pan 26. Of course, to finish the chair 10, a suitable piece of upholstery (not shown) is used to cover the back 28.

It can now be appreciated that a chair 10 constructed, as described, offers considerable improvements in comfort over prior art chair constructions using upholstered foam padding assemblies. As best seen in FIG. 9, the innermost layer of foam 46 is substantially uncompressed across its entire surface as the form 28 is upholstered. Likewise, the second layer 48 is only partially compressed as the upholstery is stretched over and fastened to the form 28. Thus, the layers 46 and 48 present a very soft feel as the user is seated in the chair. It can also be appreciated that the novel ribs 30 provided in the form 28 at the lumbar region of the user's back adds further compressibility to the foam layers 46, 48 and 50, increasing the comfort to the user as the user leans back in the chair 10.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A cushion for a chair comprising:

a rigid body member having a central relatively flat pan portion between at least two marginal edge portions;

an upstanding ridge formed along each of said two marginal edge portions and integral with said pan portion defining a depressed space central of said body member, said ridges having a predetermined height with top edges;

a first piece of compressible foam placed within and substantially filling the depressed space of said body member, said first piece of foam having a height approximately the height of the ridges;

a second piece of compressible foam overlying said first piece of foam, said second piece of foam extending over said top edges of and around said ridges; and a piece of upholstery secured over aid second piece of foam;

wherein said ridges prevent compression of said first piece of foam when said piece of upholstery is secured over said second piece of foam.

2. The cushion of claim 1 wherein said upholstery is tightly stretched around said ridges and secured to a back side of said body member.

3. The cushion of claim 1 wherein said depressed space of said body member is provided with spaced ribs for enhancing the compressibility of said first piece of foam.

* * * * *